United States Patent [19]

Leaf

[11] Patent Number: 4,653,120

[45] Date of Patent: Mar. 31, 1987

[54] HOSPITAL-TYPE GOWN WITH FRONT AND REAR OPENINGS

[76] Inventor: Sallie Leaf, 364 Charal La., Highland Park, Ill. 60035

[21] Appl. No.: 800,779

[22] Filed: Nov. 22, 1985

[51] Int. Cl.[4] ..... A41B 9/00

[52] U.S. Cl. ..... 2/114; 2/DIG. 7

[58] Field of Search ..... 2/DIG. 7, 114, 74, 105, 2/109, 69

[56] References Cited

U.S. PATENT DOCUMENTS

| | | | |
|---|---|---|---|
| 513,633 | 1/1894 | Converse | 2/109 |
| 646,194 | 3/1900 | Sims | 2/114 |
| 1,233,156 | 7/1917 | Zies | 2/114 |
| 3,141,175 | 7/1964 | Heater et al. | 2/74 |

*Primary Examiner*—Doris L. Troutman

*Attorney, Agent, or Firm*—Cook, Wetzel & Egan, Ltd.

[57] ABSTRACT

A gown, such as for a patient's use in a hospital or doctor's office, has front and rear openings extending from the neck to the hem. The rear of the gown is permanently closed at the neck only, with an overlap between the left and right side panels extending to the hem. The gown can be opened anywhere down the back, below the neckline, between the overlapped panels. One or more releasable ties at the back maintain the patient's modesty. The front panels of the gown are not permanently closed but are joined in overlapping relation by releasable ties. The gown thus can be put on like a coat, and easily tied by a patient in the front. A doctor or nurse can nonetheless readily remove the gown from the patient over the head, or pull the gown aside, for examination or treatment.

7 Claims, 6 Drawing Figures

HOSPITAL-TYPE GOWN WITH FRONT AND REAR OPENINGS

The present invention relates to garments, particularly to garments worn by patients as primary covering during medical treatment in doctors' offices, hospitals, and the like.

Known forms of hospital gowns have solid front panels and a single rear opening extending from the neck to the hem. Such gowns must be put on in reverse, and a patient typically needs assistance in tying the rear ties. The rear flaps typically fly open, so as to lose a patient's modesty. This is in part because the inner flap is not supported in its overlapped position, but is free to fall to the center, reducing or eliminating the overlap. The solid front of the conventional hospital gown restricts medical access to the front of the patient, particularly the chest. Despite many minor variations in gown design, these problems have not been successfully overcome until the present invention.

In accordance with the principles of the present invention, a hospital-type gown is provided with both front and rear openings between right and left side panels of the gown. The rear panels are permanently joined together at the neckline with an overlap in excess of several inches, preferably from 4 to 7 inches. The overlap continues the length of the gown, to the hem, and is secured at at least one point with a removable tie. The front of the gdown has no permanent closure but is overlapped and secured at one or two or more removable tie locations. The gown of the invention thus can be put on and worn like a coat, pre-tied at the rear, and then releasably tied at the front. A doctor or nurse can quickly remove the entire gown or otherwise obtain access to any part of the patient's body for examination or treatment, yet the gown well preserves the patient's modesty in all circumstances.

In the drawing figures, FIGS. 1 and 2 are general perspective views of the front and rear of a prior art hospital gown;

Figure 1:
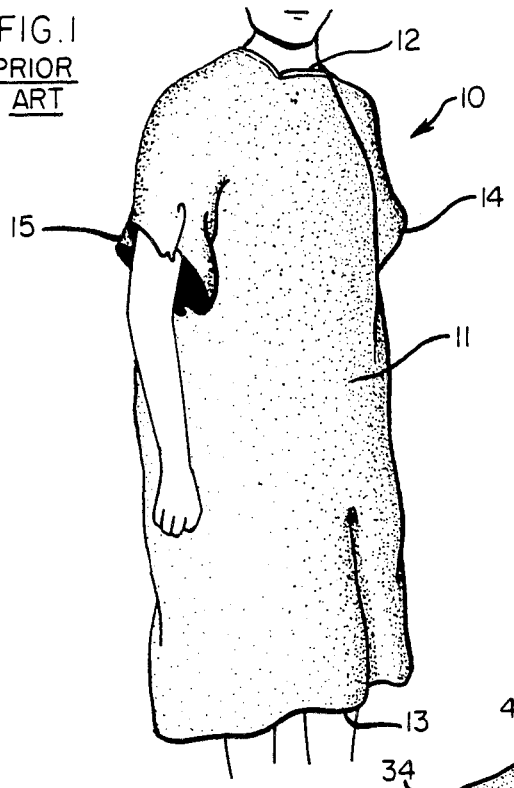
FIG. 1 PRIOR ART
Figure 2:
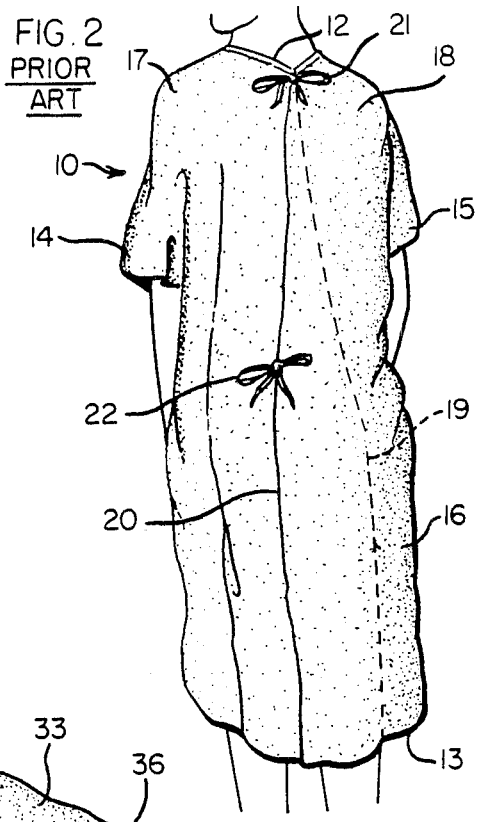
FIG. 2 PRIOR ART

A prior art gown over which the present invention is a departure and great improvement is shown in FIGS. 1 and 2. The prior art gown 10 has a solid front panel 11 extending from a neckline 12 to a hemline 13 at about the knee of a patient. Loose sleeves 14, 15 are typically provided, the diameter of the sleeves being such that an intravenous feed or treatment bottle connected to the arm can be passed through the sleeve when it is necessary to remove or change the gown 10.

The rear of the prior art gown 10 is shown at 16 in FIG. 2. The rear 16 comprises a left panel 17 and a right panel 18. The rear panels are permanently joined to the solid front panel 11 at the shoulders and down the sides of the gown. The panel 17 ends in a free vertical edge 19, while the right panel 18 ends in a free vertical edge 20, as shown. A top tie 21 connects the panels 17 and 18 together at the neckline 12, without substantial overlap, and a second tie 22 hopefully holds the panels 17 and 18 closed at about the waist, with the edges 19 and 20 well overlapped. It is found in practice, however, that the edge 19 will curl under the panel 18 so as to fall vertically from the tie 21 at the neckline 12, so as to substantially reduce if not entirely eliminate the desired overlap.

Because the prior art gown 10 has no front opening, the gown must be put on in reverse. The ties 21 and 22 can be manipulated only by a most agile patient, so they normally are tied by a nurse or another patient. The solid front 11 of the prior art gown 10 restricts access to the front and chest of the patient, often requiring partial or complete removal of the gown for examination and treatment. Dispite these disadvantages and the immodesty of the failure of the rear overlap, the prior art gown continues in virtually exclusive use in U.S. hospitals and medical offices.

The gown 30 of the present invention is depicted in FIGS. 3 through 6. It is made of any conventional woven or non-woven fabric, paper, or other convenient sheet-form material. The gown 30 comprises a front left panel 31, a front right panel 32, a left rear panel 33, and a right rear panel 34. Each of the panels extends from a neckline 35 and shoulders 36 to a hem 37, at about the patient's knees. Sleeves 38, 39 are of conventional design and cut.

The gown 30 has a front opening between the left and right front panels 31, 32. One edge 40 of the right panel 32 passes beyond the right edge 41 of the left panel 31, as shown. The edge 40 of the panel 32 is temporarily affixed to the left panel 31, with the overlap shown, at upper and lower ties 42, 43.

Figure 4:
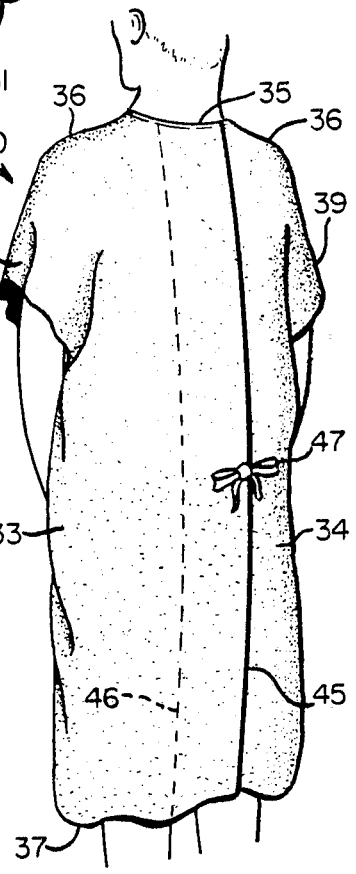
FIG. 4 is a rear perspective view, partly from the left, of a gown embodying the present invention.

The rear panels 33, 34 of the gown 30 respectively have right and left edges 45, 46 which overlap as shown in FIG. 4. This overlap is secured by a permanent connection, by stitching or the like, at the neckline 35. The edges 45, 46 are overlapped at least about 4 inches at the neckline 35, up to about 7 inches, and preferably about 5½ inches. The free edges of the rear panels are cut relatively straight so that they fall vertically downwardly. This cut eliminates any tendency of the panels to curl and thus reduce the overlap or even to open. A tie 47 is affixed between the right edge 45 of the left rear panel 33 and a portion of the right rear panel 34 spaced from the edge 46. The tie 47 maintains the patient's modesty in the rear.

Figure 5:
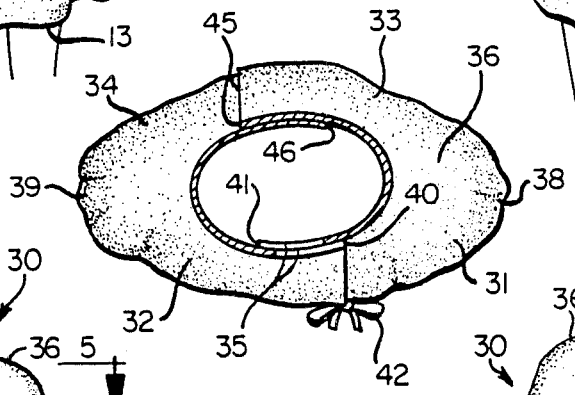
FIG. 5 is a top plan view, partly in section, taken on line 5—5 of FIG. 3.
Figure 3:
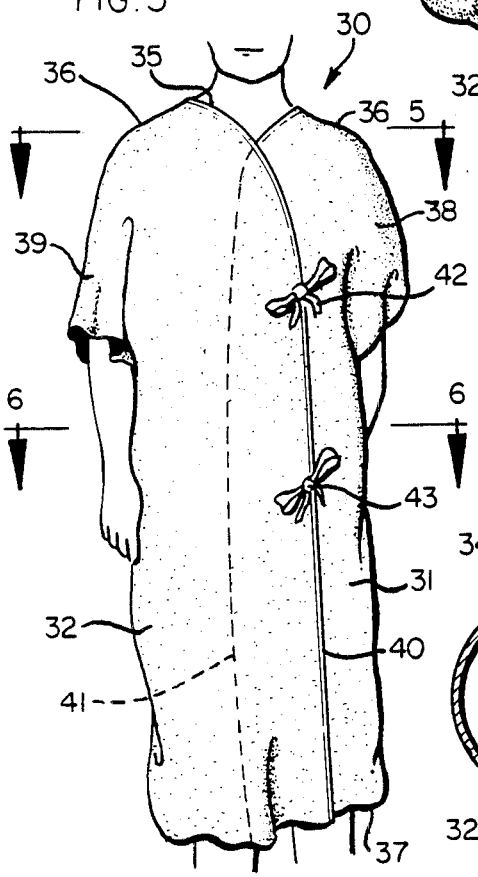
FIG. 3 is a front perspective view of a patient wearing a gown embodying the present invention.
Figure 6:
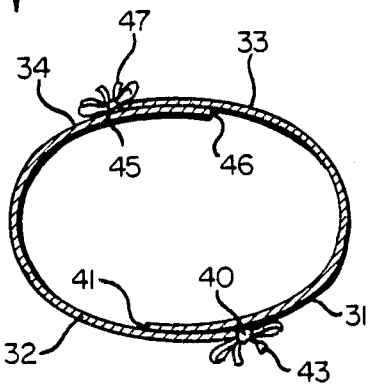
FIG. 6 is a cross sectional view of the gown, taken on line 6—6 of FIG. 3.

The overlappings of the left and right panels at the front and rear are also depicted in FIGS. 5 and 6. FIG. 5 is a section just below the neckline through the gown, and FIG. 6 is a section taken at about the waist, above the lower front tie 43 and the rear tie 47.

In use, the rear tie 47 is pre-connected as shown. The gown 30 then is put on just as a coat or a shirt, with the connected part of the neckline 35 the rear and the opening between the left and right front flaps 31, 32 at the front. The gown 30 is settled onto the patient's shoulders with the patient's arms through the sleeves 38, 39. Then a patient with even minimum dexterity can easily tie the upper and lower front ties 42, 43. The right edge 41 of the left front panel 31 has little tendency to fold over, under the right panel 32. If it does, the patient himself can straighten it out. The rear overlap between edges 45, 46 has no tendency to open, preserving the patient's modesty in the rear.

The dual, front and rear openings also allow a physician or nurse immediate access to all parts of the patient's body, with minimal disrobing. The ties 42, 43, and 47 can be quickly untied, or the entire gown 30 can be removed over a patient's head even without the ties' being undone. This is because the rear panels 33, 34 are connected only at the neckline 35, so the gown may be pulled up enough just for the neckline 35 to clear the top of the patient's head, for complete removal of the gown.

Many minor variations will occur to those having ordinary skill in the gown manufacturing arts. The ties can be replaced with loop and eye fasteners, nylon snaps, zippers or like fastening systems, without departing from the principles of the invention. The form of the neckline and sleeves and the length of the gown are unimportant to the nature and practice of the invention. References to panels are made for convenience not to limit any economical construction of the gown from separate pieces of fabric or other sheet material.

I claim as my invention:

1. A gown for loosely covering the torso and upper legs of a person from a neckline to a hem at about the knees, the gown comprising:

left and right halves each having an opening for an arm and having front and rear vertical edges, each half of the gown being adapted to cover and to extend downwardly from one shoulder and to cover one side of the torso from about the center of the front to about the center of the back and one upper leg of the person;

the left and right halves being permanently connected together only along said neckline at the back of the gown and forming a substantial overlap between their rear edges, the rear overlap extending from about the neckline to the hem when the gown is hanging freely; and wherein the left and right halves are releasably connected together at at least one point at the front of the gown with the vertical front edge of one of the halves having a substantial overlap with the vertical front edge of the other half, the front overlap extending from below the neckline to the hem.

2. The gown as defined in claim 1, wherein the halves are also releasably connected together at at least one point at the rear of the gown between the neckline and the lower hem, with the rear edge of one half thereby fixed in overlapping relation with the rear edge of the other half.

3. The gown as defined in claim 1, wherein the substantial overlap of the rear edges is in the range of about 4 to 7 inches.

4. A gown for a medical patient, the gown being adapted to preserve the modesty of the patient while permitting medical examination and treatment of all parts of the body quickly upon need, the gown comprising left and right halves of flexible sheet material forming covers for the torso and the upper legs of the patient and extending vertically generally from the patient's neck and shoulders to about the knees, the left and right halves being joined permanently together only at the rear of the neck and there forming an overlap of a distance of at least about 4 inches, wherein the overlap continues vertically to the hem of the gown, at least one fastener releasably connecting the two halves together at the rear of the patient, and at least one additional fastener releasably connecting the two halves together at the front of the patient and there forming an overlap between the left and right halves of at least 4 inches from the chest to about the hem of the gown.

5. The gown as defined in claim 4, wherein each said fastener comprises one portion affixed to an edge of one of the left and right halves of the gown and another portion affixed to the other half spaced from the corresponding other edge.

6. The gown as defined in claim 4, wherein the overlap between the rear edges of the left and right halves of the gown is in the range of about 4 to 7 inches.

7. The gown as defined in claim 6, wherein the rear edges of the left and right halves of the gown extend freely and fall vertically from the neckline to the hem, with a substantially uniform overlap formed between the left and right halves.

* * * * *